US009450294B2

(12) United States Patent
Cho et al.

(10) Patent No.: US 9,450,294 B2
(45) Date of Patent: Sep. 20, 2016

(54) ANTENNA APPARATUS FOR PORTABLE TERMINAL

(71) Applicant: Samsung Electronics Co., Ltd., Suwon-si, Gyeonggi-do (KR)

(72) Inventors: Young-Jun Cho, Seoul (KR); Austin Kim, Seongnam-si (KR); Se-Hyun Park, Suwon-si (KR); Joon-Ho Byun, Yongin-si (KR); Kyung-Jong Lee, Hwaseong-si (KR); Byung-Man Lim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 339 days.

(21) Appl. No.: 14/055,332

(22) Filed: Oct. 16, 2013

(65) Prior Publication Data

US 2014/0132460 A1 May 15, 2014

(30) Foreign Application Priority Data

Nov. 13, 2012 (KR) ..... 10-2012-0128249

(51) Int. Cl.
*H01Q 1/24* (2006.01)
*H01Q 9/42* (2006.01)
*H01Q 21/28* (2006.01)

(52) U.S. Cl.
CPC ..... *H01Q 1/243* (2013.01); *H01Q 9/42* (2013.01); *H01Q 21/28* (2013.01)

(58) Field of Classification Search
CPC ..... H01Q 1/24; H01Q 9/42; H01Q 21/28
See application file for complete search history.

(56) References Cited

U.S. PATENT DOCUMENTS

| | | | | |
|---|---|---|---|---|
| 6,169,521 | B1 * | 1/2001 | Kitamura | H01Q 1/243 343/702 |
| 6,512,491 | B2 * | 1/2003 | Kanayama | H01Q 1/243 343/702 |
| 7,161,545 | B2 * | 1/2007 | Pan | H01Q 1/1207 343/702 |
| 8,531,338 | B2 * | 9/2013 | Ma | H01Q 1/2266 343/702 |
| 2010/0194648 | A1 * | 8/2010 | Lee | H01Q 1/243 343/702 |
| 2010/0201582 | A1 | 8/2010 | Nam et al. | |
| 2010/0255893 | A1 * | 10/2010 | Ihara | H01Q 1/243 455/575.7 |
| 2013/0335276 | A1 * | 12/2013 | Lee | H01Q 1/243 343/702 |
| 2014/0132456 | A1 * | 5/2014 | Wang | H01Q 1/242 343/702 |

* cited by examiner

*Primary Examiner* — Trinh Dinh
(74) *Attorney, Agent, or Firm* — Jefferson IP Law, LLP

(57) ABSTRACT

A portable terminal is provided. The portable terminal includes a main housing, a sub housing, a mainboard, and an electric connector. The main housing has a first antenna radiator. The sub housing is separable from the main housing and has a second antenna radiator. The mainboard is disposed in the main housing and processes a radio signal. The electric connector is disposed in the main housing. When the sub housing and the main housing are separated from each other, the electric connector electrically connects the mainboard with the first antenna radiator of the main housing. When the sub housing and the main housing are coupled, the electric connector electrically connects the mainboard with the second antenna radiator of the sub housing.

16 Claims, 10 Drawing Sheets

| ANTENNA | FREQUENCY [MHZ] | AVERAGE GAIN [DBI] | EFFICIENCY [%] |
|---|---|---|---|
| ANTENNA OF REAR HOUSING USED | 1574 | -4.2 | 38% |
| | 1575 | -4.3 | 37% |
| | 1576 | -4.3 | 37% |
| ANTENNA OF BATTERY COVER USED | 1574 | -3.1 | 49% |
| | 1575 | -3.3 | 46% |
| | 1576 | -3.4 | 46% |

FIG.10

ANTENNA APPARATUS FOR PORTABLE TERMINAL

CROSS-REFERENCE TO RELATED APPLICATION(S)

This application claims the benefit under 35 U.S.C. §119 (a) of a Korean patent application filed on Nov. 13, 2012 in the Korean Intellectual Property Office and assigned Serial No. 10-2012-0128249, the entire disclosure of which is hereby incorporated by reference.

TECHNICAL FIELD

The present disclosure relates to an antenna apparatus. More particularly, the present disclosure relates to an antenna apparatus of a mobile terminal.

BACKGROUND

As the electronic communication industry develops, a portable terminal such as a mobile communication terminal, an electronic scheduler, a Personal Digital Assistant (PDA), etc. performing wireless communication has become ubiquitous in modern society and serves as an important means for quickly transferring information.

A portable terminal provides various multimedia functions and is increasingly miniaturized to enhance the portability thereof. However, there is difficulty in mounting various elements in a limited space of a miniaturized terminal. The portable terminal has an antenna radiator for wireless communication. Recently, the antenna radiator has been formed in a shape so as to be mounted inside the terminal to make the terminal elegant and miniaturized. It is preferable that the antenna radiator maintain a sufficient level of performance in order to transmit/receive a signal in a relevant communication service band. Generally, when the antenna radiator becomes large or is located far away from an interfering element, performance improves. However, it is difficult to secure a mounting space for the antenna radiator in a limited space.

For this purpose, the antenna radiator is mounted in a detachable battery cover of the portable terminal. However, in the case where the battery cover is separated, the portable terminal cannot perform communication.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna apparatus of a portable terminal that can secure antenna performance while miniaturizing the portable terminal.

Another aspect of the present disclosure is to provide an antenna apparatus of a portable terminal that can secure antenna performance, for reducing a neighboring interference by configuring an antenna radiator in a battery cover.

Still another aspect of the present disclosure is to provide an antenna apparatus of a portable terminal that can swiftly transmit/receive a signal in place of an antenna radiator of a battery cover and maintain a communication state even when the battery cover having the antenna radiator is separated.

Yet another aspect of the present disclosure is to provide an antenna apparatus of a portable terminal that uses an antenna radiator attached to a battery cover when the battery cover is coupled to a housing, and uses an antenna radiator attached to the housing when the battery cover is separated from the housing.

In accordance with an aspect of the present disclosure, a portable terminal is provided. The portable terminal includes a main housing having a first antenna radiator, a sub housing separable from the main housing and having a second antenna radiator, a mainboard disposed in the main housing for processing a radio signal, and an electric connector disposed in the main housing, wherein, when the sub housing and the main housing are separated from each other, the electric connector electrically connects the mainboard with the first antenna radiator of the main housing, and, when the sub housing and the main housing are coupled, the electric connector electrically connects the mainboard with the second antenna radiator of the sub housing.

In accordance with another aspect of the present disclosure, an electronic device is provided. The electronic device includes a front housing disposed in front of the electronic device, a rear housing coupled to the front housing, coupled to the front housing to form a space in which a plurality of electronic parts of the electronic device are disposed, and having a first antenna radiator attached to at least one of an inner side and an outer side, a detachable rear cover disposed in a backside of the electronic device, forming a space for receiving a battery via coupling with the rear housing, and having a second antenna radiator attached to an inner side, and a mainboard disposed in the space formed by the coupling of the front housing and the rear housing, for processing a radio signal, and an elastic member attached to the mainboard and electrically connected with a Radio Frequency (RF) part mounted on the mainboard for processing a radio signal via a line, wherein the elastic member includes: a fixed piece attached to the mainboard, an elastic piece formed by bending an end of the fixed piece and giving elasticity to movement of a free end, and the free end formed by bending an end of the elastic piece and bendable while it is elastically supported, and wherein the free end includes a first contact portion for electrically contacting the first antenna radiator of the rear housing when the rear cover and the rear housing are separated from each other, and releasing the electrical contact with the first antenna radiator of the rear housing when the rear cover and the rear housing are coupled, and a second contact portion for electrically contacting the second antenna radiator of the rear cover via an opening formed in the rear housing when the rear cover and the rear housing are coupled.

An antenna apparatus of a portable terminal according to the present disclosure can improve antenna performance by configuring an antenna radiator in a battery cover and allows an antenna radiator replacing the antenna radiator of the battery cover to operate even when the battery cover is separated, thereby maintaining a swift communication state.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings in which:

FIG. 10 is a table illustrating the performance of an antenna apparatus of a portable terminal according to an embodiment of the present disclosure.

Throughout the drawings, like reference numerals will be understood to refer to like parts, components and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The present disclosure relates to an antenna apparatus and an electronic device embodying the antenna apparatus. And a portable (mobile) terminal is described as an example of the electronic device.

Figure 1:
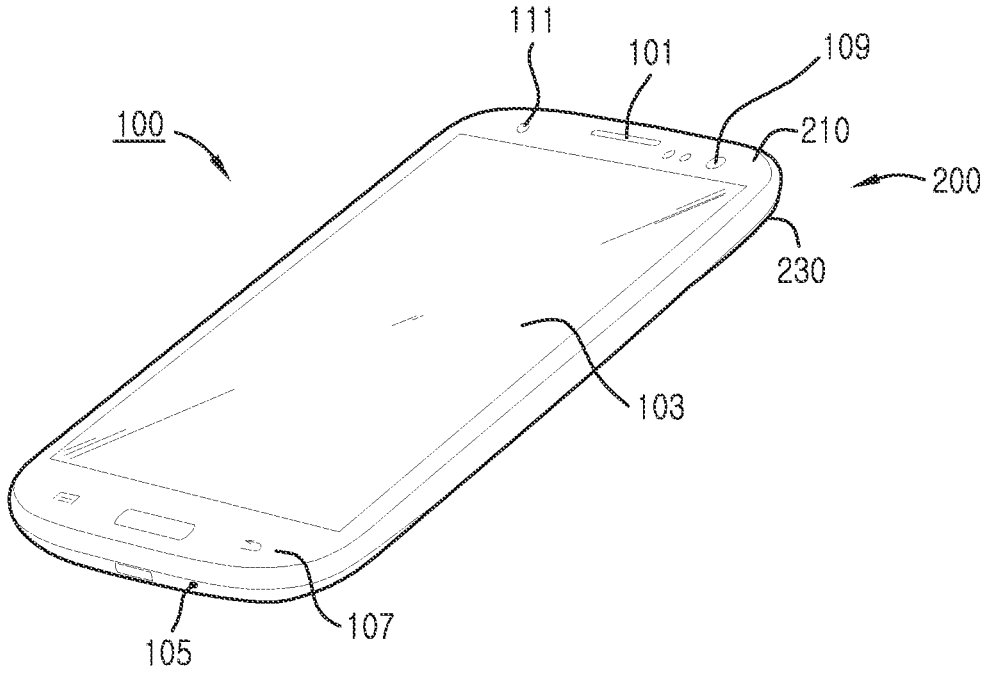
FIGS. 1 and 2 are perspective views illustrating a portable terminal according to an embodiment of the present disclosure.
Figure 2:
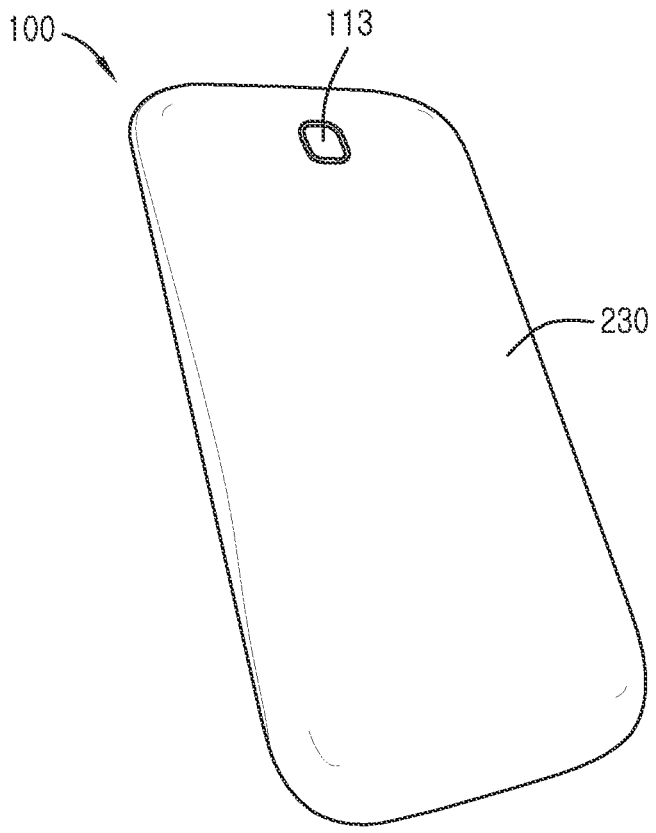
Figure 3:
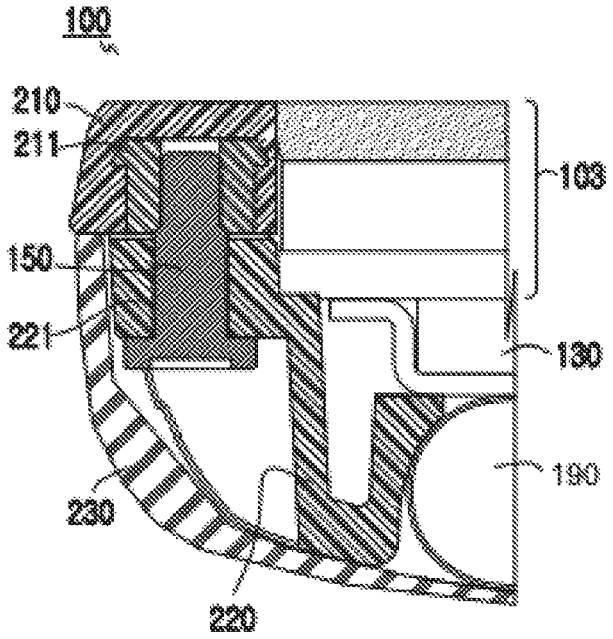
FIG. 3 is a cross-sectional view illustrating a structure of a portable terminal according to an embodiment of the present disclosure.

FIGS. 1 and 2 are perspective views illustrating a portable terminal according to an embodiment of the present disclosure, and FIG. 3 is a cross-sectional view illustrating a structure of a portable terminal according to an embodiment of the present disclosure.

Referring to FIGS. 1 and 2, the portable terminal 100 includes a speaker unit 101 for outputting sounds, a touchscreen unit 103 positioned below the speaker unit 101 and displaying an image and receiving a touch input, a microphone unit 105 positioned below the touchscreen unit 103 and receiving sounds, a keypad unit 107 on which input buttons are arranged, a front camera unit 109, a proximity sensor 111, and a rear camera unit 113.

Referring to FIG. 3, the portable terminal 100 has a housing 200 forming an appearance, and the above described elements are disposed in the receiving space of the housing 200. The housing 200 includes a front housing 210, a rear housing 220, and a rear cover 230.

The front housing 210 and the rear housing 220 are coupled, and the rear cover 230 covers the rear housing 220. The front housing 210 is disposed in front of the portable terminal 100, and the rear cover 230 is disposed in the backside of the portable terminal 100.

The front housing 210 and the rear housing 220 are coupled to form a container shape that opens to the front side of the portable terminal 100. The touchscreen unit 103 is disposed on a mainboard 130 and includes a window and a display. The touchscreen unit 103 and the mainboard 130 are mounted in a receiving space formed by coupling of the front housing 210 and the rear housing 220. A battery 190 is disposed in a space formed by coupling of the rear housing 220 and the rear cover 230. The rear cover 230 may be referred to as a battery cover.

The window is transparent and is exposed to the front side of the portable terminal 100, and an image of the display is shown via the window. The mainboard 130 is a substrate on which a circuit and a plurality of electronic parts have been mounted. The mainboard 130 sets an execution environment of the portable terminal 100, maintains the information thereof, stably drives the portable terminal 100, and allows devices of the portable terminal 100 to perform data input/output exchange.

The front housing 210 has a boss 211 for screw-coupling with the rear housing 220. The boss 211 has a screw fasten portion where a screw hole to which a screw is fastened is formed. The screw fasten portion may be metal and may be formed inside the boss 211 during, for example, injection molding. The rear housing 220 has a boss fasten hole 221 for screw-coupling with the boss 211 of the front housing 210. A screw 150 passes through the boss fasten hole 221 of the rear housing 220 and is fastened to the boss 211 of the front housing 210, so that the front housing 210 and the rear housing 220 are coupled with each other.

Figure 4:
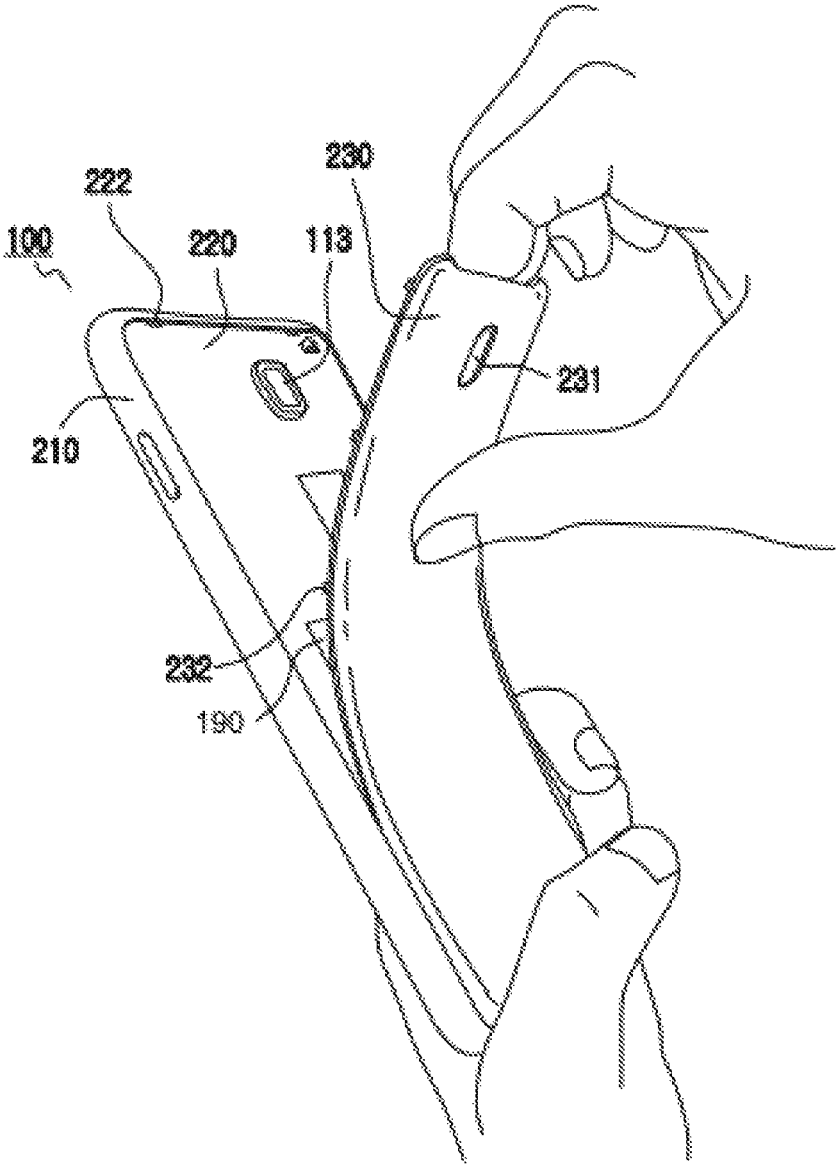
FIG. 4 is a view illustrating attachment/detachment of a rear cover of a portable terminal according to an embodiment of the present disclosure.

FIG. 4 is a view illustrating attachment/detachment of a rear cover of a portable terminal according to an embodiment of the present disclosure. The rear cover 230 can be coupled to the rear housing 220 or separated from the rear housing 220. The rear cover 230 has a snap-fit 232 disposed on an edge thereof, and the rear housing 220 has a fasten recess 222 corresponding to the snap-fit 232 at a relevant position. In the case where the rear housing 220 and the rear cover 230 are coupled, the snap-fit 232 is fastened to the fasten recess 222. In the case where the rear cover 230 is coupled to or separated from the rear housing 220, the rear cover 230 is elastically warp-transformed as illustrated. Also, the rear cover 230 has an opening 231 for exposing the camera unit 113 disposed in the front housing 210 and the rear housing 220.

Figure 5:
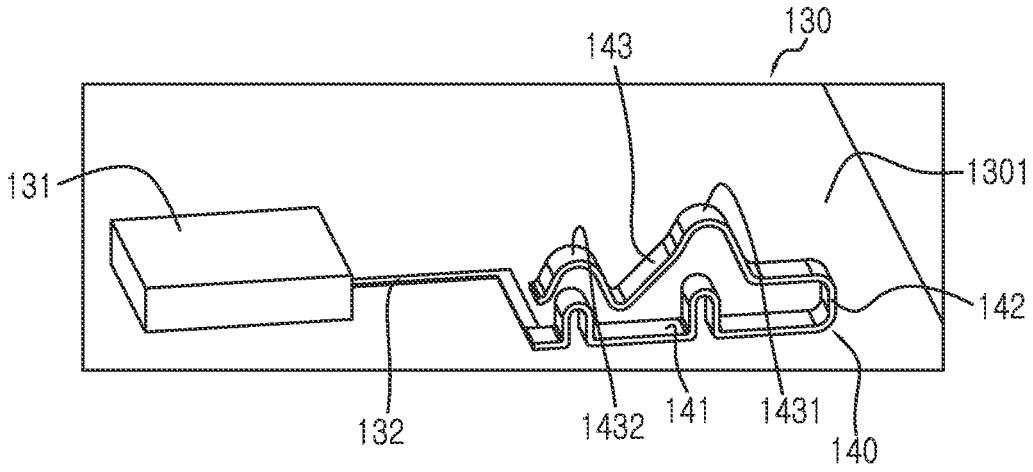
FIG. 5 is a perspective view illustrating a mainboard of a portable terminal according to an embodiment of the present disclosure.

FIG. 5 is a perspective view illustrating a mainboard of a portable terminal according to an embodiment of the present disclosure.

Referring to FIG. 5, the mainboard 130 of the portable terminal includes a substrate on which a basic circuit and a plurality of electronic parts have been mounted. The mainboard 130 sets an execution environment of the portable terminal 100, maintains the information thereof, stably drives the portable terminal 100, and allows devices of the portable terminal 100 to perform data input/output exchange. The mainboard 130 surface-mounts a Radio Frequency (RF) part 131 related to a radio signal via an antenna radiator, for example, an RF connector, a mobile communication part, a band pass filter, an antenna matching device, etc. Also, the mainboard 130 includes an elastic member 140 for contact that is attached on a surface 1301. The mainboard 130 includes a line 132 mounted in a pattern type. The elastic member 140 for contact and the RF part 131 are electrically connected via the line 132.

The elastic member 140 for contact is integrally formed via bending of a metal plate, and includes a fixed piece 141, an elastic piece 142 formed by bending the end of the fixed piece 141, and a free end 143 formed by bending the end of the elastic piece 142.

The fixed piece 141 is attached to the surface 1301 of the mainboard 130. For the attaching means, soldering, an adhesive, screw fastening, etc. can be applied. The fixed piece 141 is electrically connected with the line 132.

The elastic piece 142 can have a physical property of high elasticity via heat treatment, and gives elasticity to the movement of the free end 143.

The free end 143 is elastically supported and bent from the elastic piece 142. When external force is removed, the free end 143 is restored to an initial position. The free end 143 is separated by a predetermined distance from the surface 1301 of the mainboard 130 and is divided into a first contact portion 1431 and a second contact portion 1432 having different heights, respectively. The first contact portion 1431 close to the elastic piece 142 is positioned higher than the second contact portion 1432 close to an open end from the surface 1301 of the mainboard 130. Therefore, when the first contact portion 1431 is pressed downward, the free end 143 is drooped downward and the second contact portion 1432 is also moved downward. The first contact portion 1431 and the second contact portion 1432 contact a feeding portion of the antenna radiator and supply a current to the antenna radiator. The antenna radiator is supplied with a current via the feeding portion, resonates, and can transmit or receive a radio signal in a relevant frequency band.

As described above, the elastic member 140 for contact may be attached to the mainboard 130, but it is not limited thereto and it can be also attached to the front housing 210 or the rear housing 220.

Figure 6:
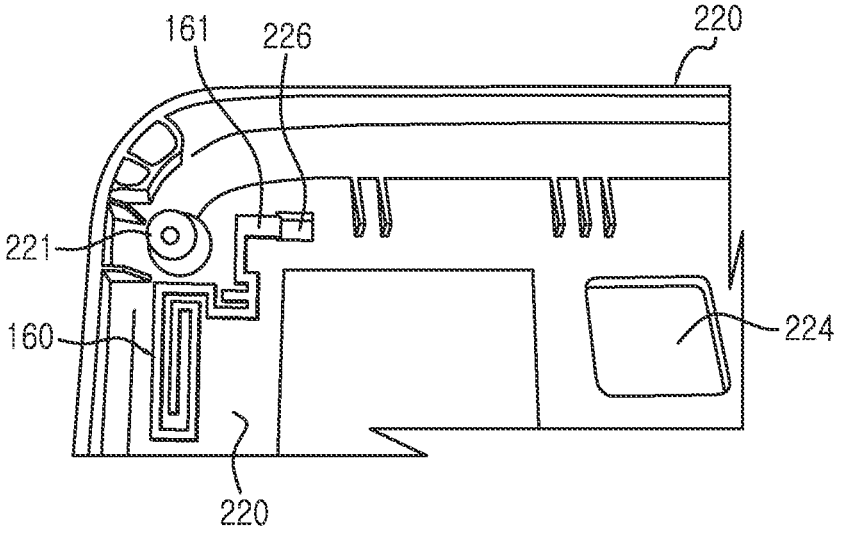
FIG. 6 is a perspective view illustrating a rear housing of a portable terminal according to an embodiment of the present disclosure.

FIG. 6 is a perspective view illustrating a rear housing of a portable terminal according to an embodiment of the present disclosure.

Referring to FIG. 6, the rear housing 220 forms a boss 221 for screw-coupling with the front housing 210 in the inside, and has an opening 224 for exposing the camera unit 113. Also, the rear housing 220 includes an antenna radiator 160 attached to the inner side. A portion of the antenna radiator 160 can be extended up to the outer side from the inner side of the rear housing 220 via the opening. The antenna radiator 160 can be attached to the flat surface of the rear housing 220 and can be attached in such a way that it is safely seated in a groove formed to have a step on the surface of the rear housing 220. Also, through insert injection, the rear housing 220 can be formed and simultaneously the antenna radiator 160 can be fixed to the rear housing 220.

The antenna radiator 160 has a feeding portion 161 in its one end. Also, the rear housing 220 has an opening 226 for partially projecting the first contact portion 1431 of the elastic member 140 for contact of the mainboard 130 to the outside. The mainboard 130 is fixed in the space formed by coupling of the front housing 210 and the rear housing 220. The second contact portion 1432 of the elastic member 140 for contact of the mainboard 130 electrically contacts the feeding portion 161 of the antenna radiator 160 of the rear housing 220. The first contact portion 1431 of the elastic member 140 for contact of the mainboard 130 is partially exposed via the opening 226 of the rear housing 220. The second contact portion 1432 of the elastic member 140 for contact elastically presses the feeding portion 161 of the antenna radiator 160.

Figure 7:
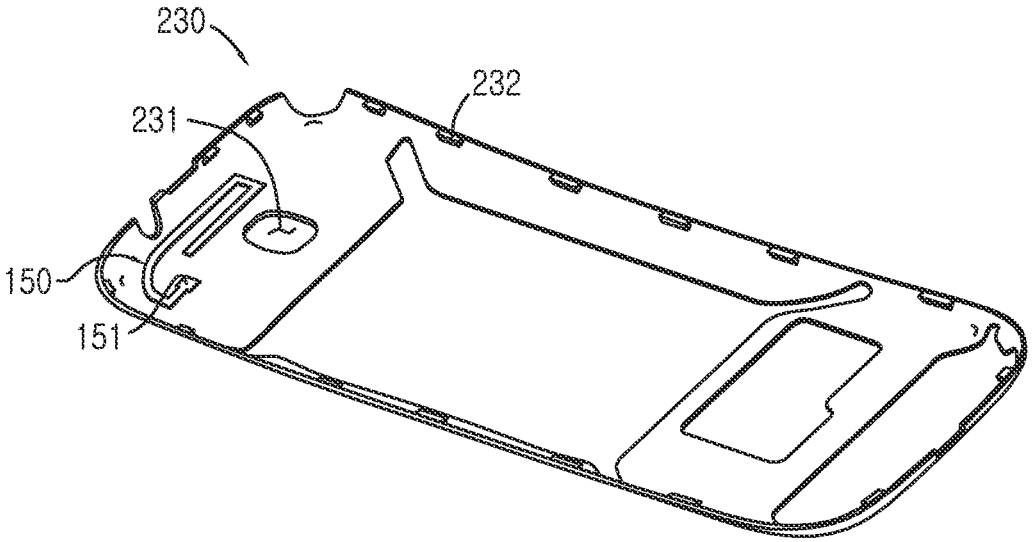
FIG. 7 is a perspective view illustrating a rear cover of a portable terminal according to an embodiment of the present disclosure.

FIG. 7 is a perspective view illustrating a rear cover of a portable terminal according to an embodiment of the present disclosure.

Referring to FIG. 7, the rear cover 230 has a snap-fit 232 disposed on an edge thereof. In the case where the rear housing 220 and the rear cover 230 couple to each other, the snap-fit 232 is fastened to the fasten recess 222 of the rear housing 220. Also, the rear cover 230 has the opening 231 for exposing the camera unit 113 disposed in the front housing 210 and the rear housing 220.

Also, the rear cover 230 includes an antenna radiator 150 attached to the inner side. The antenna radiator 150 can be attached to the flat surface of the rear cover 230 and can be attached in such a way that it is safely seated in a groove formed to have a step on the surface of the rear cover 230. Also, through insert injection, the rear cover 230 can be formed and simultaneously the antenna radiator 150 can be fixed to the rear cover 230. The rear cover 230 has a high degree of freedom in design of an antenna radiator compared to the front housing 210 and the rear housing 220. Also, the antenna radiator 150 of the rear cover 230 can secure a separated distance from the mainboard 130 and thus is less interfered and can secure increased antenna performance.

The antenna radiator 150 of the rear cover 230 has a feeding portion 151 in its one end. The mainboard 130 is fixed in the space formed by coupling of the front housing 210 and the rear housing 220. In the case where the rear cover 230 is separated from the rear housing 220, the second contact portion 1432 of the elastic member 140 for contact of the mainboard 130 electrically contacts the feeding portion 161 of the antenna radiator 160 of the rear housing 220. The first contact portion 1431 of the elastic member 140 for contact of the mainboard 130 partially protrudes via the opening 226 of the rear housing 220. In contrast, in the case where the rear cover 230 is coupled to the rear housing 220, the first contact portion 1431 of the elastic member 140 for contact that protrudes via the opening 226 of the rear housing 220 electrically contacts the feeding portion 151 of the antenna radiator 150 of the rear cover 230. At this point, the first contact portion 1432 is pressed downward and is moved downward from a position before the rear cover 220 is mounted. When the first contact portion 1431 is moved downward, that is, the free end 143 is drooped downward, the second contact portion 1432 is also moved downward, and the electrical contact between the antenna radiator 160 of the rear housing 220 and the second contact portion 1432 is released.

Figure 8:
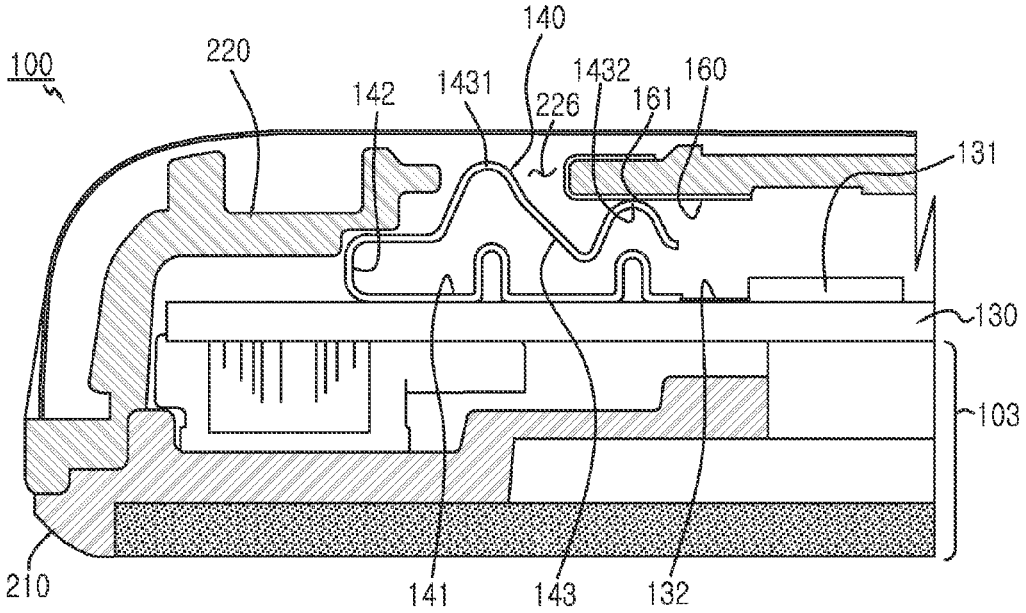
FIG. 8 is a cross-sectional view illustrating a separated state of a rear cover in a portable terminal according to an embodiment of the present disclosure.

FIG. 8 is a cross-sectional view illustrating a separated state of a rear cover in a portable terminal according to an embodiment of the present disclosure.

Referring to FIG. 8, the mainboard 130 is fixed in the space formed by coupling between the front housing 210 and the rear housing 220. In the case where the rear housing 220 and the rear cover 230 are separated, the second contact portion 1432 of the elastic member 140 for contact of the mainboard 130 electrically contacts the feeding portion 161 of the antenna radiator 160 of the rear housing 220, and the first contact portion 1431 of the elastic member 140 for contact of the mainboard 130 partially protrudes via the opening 226 of the rear housing 220.

In the case where the rear cover 230 is separated, the mainboard 130 processes a radio signal transmitted/received via the antenna radiator 160 of the rear housing 220.

Figure 9:
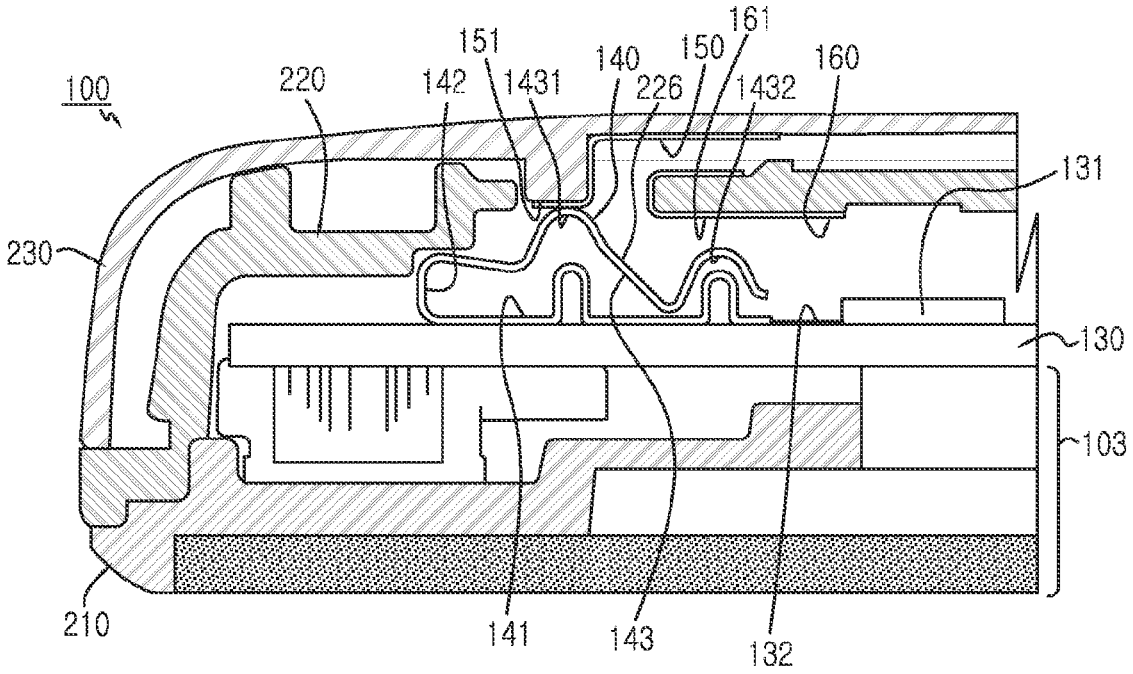
FIG. 9 is a cross-sectional view illustrating a coupled state of a rear cover in a portable terminal according to an embodiment of the present disclosure.

FIG. 9 is a cross-sectional view illustrating a coupled state of a rear cover in a portable terminal according to an embodiment of the present disclosure.

Referring to FIG. 9, the mainboard 130 is fixed in the space formed by coupling of the front housing 210 and the rear housing 220. In the case where the rear cover 230 is coupled to the rear housing 220, the first contact portion 1431 of the elastic member 140 for contact protruding via the opening 226 of the rear housing 220 electrically contacts the feeding portion 151 of the antenna radiator 150 of the rear cover 230. At this point, the first contact portion 1432 is pressed downward and is moved downward from a position before the rear cover 220 is mounted. When the first contact portion 1431 is moved downward, that is, the free end 143 is drooped downward, the second contact portion 1432 is also moved downward, and the electrical contact between the antenna radiator 160 of the rear housing 220 and the second contact portion 1432 is released.

In the case where the rear cover 230 is coupled, the mainboard 130 processes a radio signal transmitted/received via the antenna radiator 150 of the rear cover 230 in place of the antenna radiator 160 of the rear housing 220.

FIG. 10 is a table illustrating the performance of an antenna apparatus of a portable terminal according to an embodiment of the present disclosure.

Referring to FIG. 10, antenna performance has been measured in a Global Positioning System (GPS) communication band. The measurement result shows a case of using the antenna radiator 150 of the rear cover (battery cover) 230 and has improvement of about 1 dB in antenna performance compared to a case of using the antenna radiator 160 of the rear housing 220. As described above, the antenna radiator 150 of the rear cover 230 can secure a separated distance from the mainboard 130 to reduce interference and secure increased antenna performance. Also, even in the case where the battery cover 230 is separated and the antenna radiator 160 of the rear housing 220 is used, sufficient antenna performance in the case of using the antenna radiator 150 of the rear cover 230 is obtained. Consequently, the antenna apparatus of the present disclosure can transmit/receive a signal in place of the antenna radiator of the battery cover even when the battery cover having the antenna radiator is separated, and so the antenna apparatus can maintain a communication state.

As illustrated, the antenna radiator 160 of the rear housing 220 and the antenna radiator 150 of the rear cover 230 can be a mono pole antenna radiator, a Planar Inverted-F Antenna (PIFA) radiator, or any other similar and/or suitable type of radiator. In a case of applying a PIFA radiator, the antenna radiators 150 and 160 have not only a feeding portion for feeding electricity but also a grounding portion for grounding. Also, the elastic member 140 for contact can have two free ends separated from each other and corresponding to the feeding portion and the ground portion of an antenna radiator. One of the free ends is electrically connected with an RF part of the mainboard 130 via a line, and the other free end is electrically connected with the ground of the mainboard 130.

The antenna radiator 160 of the rear housing 220 and the antenna radiator 150 of the rear cover 230 can transmit/receive a signal in at least one same communication band. The shapes of the two antenna radiators can be the same or different from each other. For example, since the antenna radiator 160 of the rear housing 220 and the antenna radiator 150 of the rear cover 230 are adjacent to each other and the antenna radiator supplied with electricity may be deteriorated due to interference of the other antenna radiator, the shapes of the antenna radiators 150 and 160 can be determined with consideration of this aspect.

Also, the portable terminal 100 according to the present disclosure can configure a plurality of antenna apparatuses. For example, the plurality of antenna apparatuses can include an antenna apparatus for voice communication, an antenna apparatus for video communication, an antenna apparatus for GPS communication, an antenna apparatus for Bluetooth communication, an antenna apparatus for Near Field Communication (NFC) communication, and an antenna apparatus for other communications. One of these antenna apparatuses can configure an antenna apparatus mounted in a thin plate shape on the mainboard 130. Also, the above-described antenna apparatus according to the present disclosure may be applied to at least one of the above various antenna apparatuses.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing including a first antenna radiator;

a cover separable from the housing and including a second antenna radiator;

a circuit board disposed in the housing and configured to process a radio signal via the first antenna radiator or the second antenna radiator; and an elastic metal member disposed on the circuit board for electrically connecting the circuit board to the first antenna radiator or the second antenna radiator, wherein, when the cover is separated from the housing, a first portion of the elastic metal member is contacted with the first antenna radiator of the housing, and wherein, when the cover is coupled to the housing, a second portion of the elastic metal member is contacted with the second antenna radiator of the cover, and the contact between the first portion and the first antenna radiator is released.

2. The electronic device of claim 1, wherein, when the cover is coupled to the housing, the contact between the first portion and the first antenna radiator is released because of a deflection of the elastic metal member by a pressure of the cover.

3. The electronic device of claim 1, wherein the elastic metal member comprises:

a fixed part coupled to the circuit board; and an extension part extended from the fixed portion and comprising the first and second portions, the extension part bendable elastically, wherein the second portion is farther from the circuit board than the first portion, wherein, when the cover is coupled to the housing, the second portion is moved toward the circuit board by a pressure of the cover, and the first portion is moved toward the circuit board by the movement of the second portion to be physically separated from the first antenna radiator.

4. The electronic device of claim 3, wherein the second portion of the elastic metal member is contacted with the second antenna radiator of the cover via an opening formed in the housing.

5. The electronic device of claim 4, wherein, when the cover is coupled to the housing, a portion of the cover is inserted into the opening the housing, and wherein a contact of the second antenna radiator for electronically connecting with the second portion of the elastic metal member is disposed on the portion of the cover.

6. The electronic device of claim 3, wherein the elastic metal member is integrally formed by a method of bending a metal plate.

7. The electronic device of claim 1, wherein the circuit board includes at least one RF (radio frequency) part, which is electronically connected to the elastic metal member, for processing the radio signal.

8. The electronic device of claim 1, wherein the housing is formed by a insert molding to be coupled to the first antenna.

9. The electronic device of claim 1, wherein the cover is formed by a insert molding to be coupled to the second antenna radiator.

10. The electronic device of claim 1, wherein one of the first antenna radiator and the second antenna radiator comprises one of a monopole antenna radiator and a Planar Inverted-F Antenna (PIFA) radiator.

11. The electronic device of claim 1, wherein the housing comprises:

a front housing; and a rear housing coupled to the front housing.

12. The electronic device of claim 1, wherein a battery for the electronic device is separable from the portable terminal when the cover is separated from the portable terminal.

13. The electronic device of claim 1, wherein the first antenna radiator and the second antenna radiator transmit and receive a signal in at least one same communication band.

14. The electronic device of claim 1, wherein at least one of the first antenna radiator and the second antenna radiator is used for one of voice communication, video communication, Global Positioning System (GPS) communication, Bluetooth communication, and Near Field Communication (NFC) communication.

15. An electronic device comprising:

a front housing disposed in front of the electronic device;

a rear housing coupled to the front housing, coupled to the front housing to form a space in which a plurality of electronic parts of the electronic device are disposed, and having a first antenna radiator attached to at least one of an inner side and an outer side;

a detachable rear cover disposed in a backside of the electronic device, forming a space for receiving a battery via coupling with the rear housing, and having a second antenna radiator attached to an inner side;

a circuit board, which is disposed in the space formed by the coupling of the front housing and the rear housing, for processing a radio signal via the first antenna radiator or the second antenna radiator; and an elastic member disposed on the circuit board and electrically connected with a Radio Frequency (RF) part mounted on the circuit board for processing the radio signal via a line, wherein the elastic member comprises:

a fixed piece coupled to the circuit board, an elastic piece formed by bending an end of the fixed piece and giving elasticity to movement of a free end, and the free end formed by bending an end of the elastic piece and bendable while it is elastically supported, and wherein the free end comprises:

a first contact portion for electrically contacting the first antenna radiator of the rear housing when the rear cover and the rear housing are separated from each other, and releasing the electrical contact with the first antenna radiator of the rear housing when the rear cover and the rear housing are coupled and a second contact portion for electrically contacting the second antenna radiator of the rear cover via an opening formed in the rear housing when the rear cover and the rear housing are coupled.

16. A portable terminal comprising:

a housing including a first antenna radiator;

a cover separable from the housing and including a second antenna radiator;

a circuit board disposed in the housing and configured to process a radio signal via the first antenna radiator or the second antenna radiator; and an elastic metal member disposed in the housing for electrically connecting the circuit board to the first antenna radiator or the second antenna radiator, wherein the elastic metal member comprises:

a first portion coupled to the circuit board, and a second portion extended from the first portion and separated from the circuit board, the second portion deflectable toward the circuit board by coupling between the housing and the cover, wherein the second portion comprises a first contact portion used for electrically connecting to the first antenna radiator of the housing, and a second contact portion used for electrically connected to the second antenna radiator of the cover, wherein, when the cover is separated from the housing, the first contact portion is contacted with the first antenna radiator of the housing, and wherein, when the cover is coupled to the housing, the second contact portion is contacted with the second antenna radiator of the cover, and the contact between the first contact portion and the first antenna radiator is released by the deflection of the second portion.

* * * * *